United States Patent [19]

Grigg

[11] 4,312,346

[45] Jan. 26, 1982

[54] EXPANDABLE ASHTRAY

[76] Inventor: Charles E. Grigg, 24551 Big Basin Way, Saratoga, Calif. 95070

[21] Appl. No.: 136,177

[22] Filed: Mar. 31, 1980

[51] Int. Cl.[3] ..... A24F 19/00

[52] U.S. Cl. ..... 128/242

[58] Field of Search ..... 131/231, 240, 242; 220/4 A, 4 C

[56] References Cited

U.S. PATENT DOCUMENTS

| | | | |
|---|---|---|---|
| 417,398 | 12/1889 | Sneli | 220/4 C |
| 1,588,043 | 6/1926 | Mower | 131/242 X |
| 2,894,655 | 7/1959 | Bergan | 131/242 X |

*Primary Examiner*—Stephen C. Pellegrino

*Attorney, Agent, or Firm*—Gerald L. Moore

[57] ABSTRACT

An ashtray in which ashes and burned cigarettes are stored in an enclosed compartment for safety against fires and to prevent the resulting smells from spreading. The ashtray can be made larger or smaller depending upon the need for storage.

1 Claim, 4 Drawing Figures

EXPANDABLE ASHTRAY

BACKGROUND OF THE INVENTION

Ashtrays which have open compartments permit the smells of the ashes and burnt cigarettes and cigars to permeate the room. Additionally there always exists the possibility that one of the cigarettes will remain burning and will ignite the other waste and cause a fire. It is the purpose of the present invention to provide an ashtray which encloses the ashes, burnt cigarettes and waste so as to prevent the smells from permeating the room and limit the possibility of fire resulting from the refuse in the ashtray catching fire.

SUMMARY OF THE INVENTION

A cigarette ashtray comprising a housing having a top, side walls and a bottom forming a closed center compartment. The top comprises a wall member with vertically extending side walls forming a dish for holding cigarette ashes and the side walls include grooves for receiving and holding cigarettes.

The top also includes surfaces which interfit with the top edge of the side walls such that the top can be removed and emptied into the compartment. In addition the side walls are formed of interfitting vertically stacked sections which can be removed individually for varying the storage capacity of the internal compartment.

DESCRIPTION OF THE INVENTION

Figure 1:
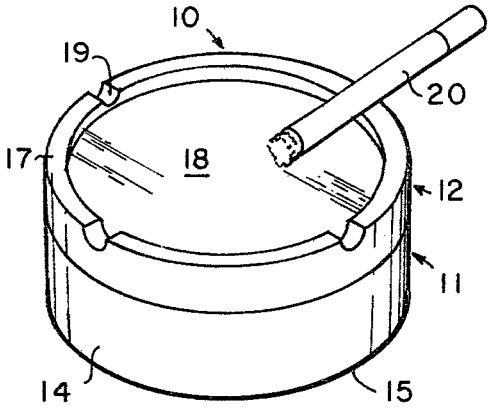
FIG. 1 is a perspective view of one embodiment of the ashtray.

In FIG. 1 a first embodiment of the invention is shown in the form of the ashtray 10 including a housing 11 and a top 12. The housing 11 is cylindrical in configuration and comprises side walls 14 and a bottom 15. As shown, the top 12 interfits with the top edge of the side walls to form an internal cavity 16. The top 12 includes vertically extending sides or side walls 17 forming with a bottom wall 18 an ash receptacle. The sides include grooves 19 for holding burning cigarettes 20 in the normal manner. The top 12 fits over the top edge of the side walls 14 with a slip or friction fit and forms therewith the internal compartment 16 for the storage of cigarette butts, ashes and other refuse. The ashtray is used in the normal manner shown in the drawing with the top serving to hold the ashes on the top wall 18 and within the cylindrical side 15.

After the cigarette is put out, the top is grasped and lifted from engagement with the side walls and can thereafter be inverted for emptying the ashes and cigarette butts into the compartment 16 for storage. By doing so the smells and other bad odors as well as the unsightly appearance are done away with since the refuse is contained in a closed compartment after the top is put back on in the manner shown in the drawing.

Figure 2:
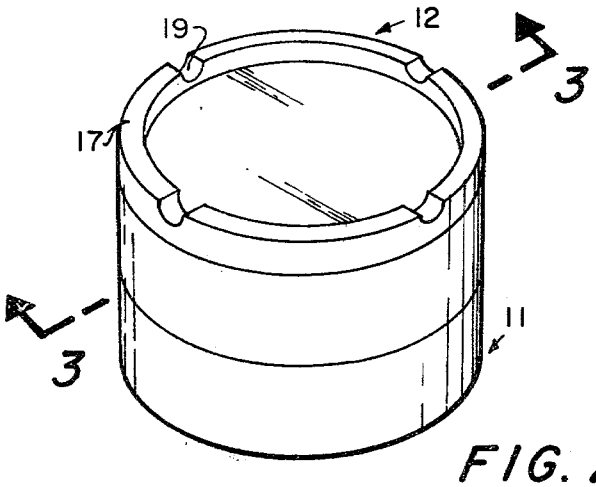
FIG. 2 is a perspective view of a second embodiment of the ashtray.
Figure 3:
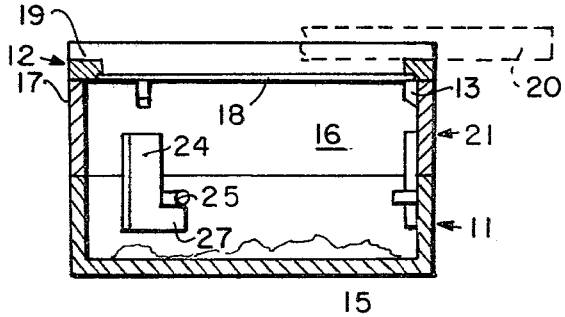
FIG. 3 is a cross-sectional view along the line 3—3 of FIG. 2.
Figure 4:
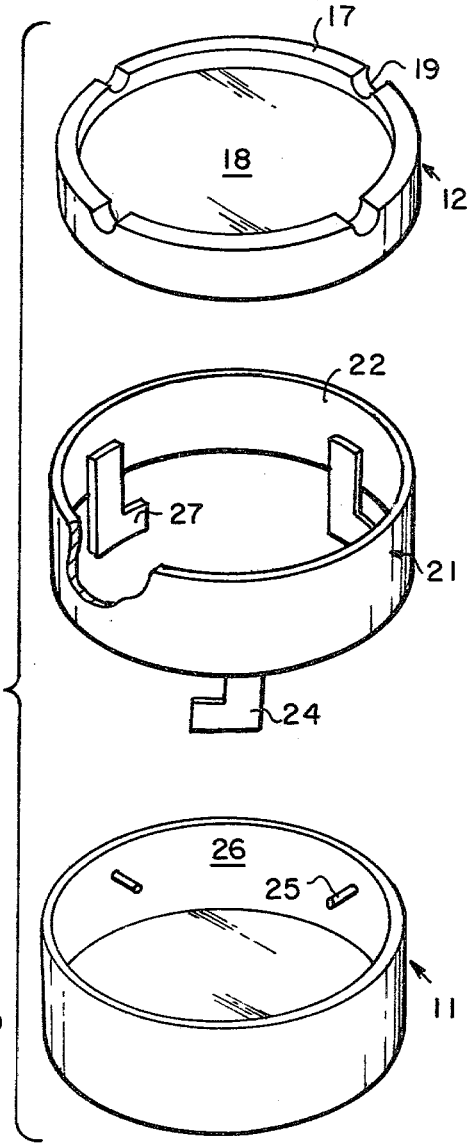
FIG. 4 is an exploded view of the embodiment shown in FIG. 2.

In FIGS. 2, 3 and 4 is shown a second embodiment of the invention incorporating the bottom 11 and the top 12 which function in the same manner as described. Inserted between the bottom and the top is an intermediate wall section or extension 21 comprising a cylinder 22 of the identical cross-section as the side walls 14 in FIG. 1. This intermediate section is placed over the bottom section 11 such that the locking extensions 24 fit inside the side walls 14 and adjacent to pins 25 extending from the inner wall surface 26 of the bottom section. By grasping the bottom section 11 in one hand and the top intermediate section 21 in the other and twisting the intermediate section in the clockwise direction, the side extension 27 of each locking extension can be moved to an overlapping position with the adjacent pin and serve to lock the intermediate section onto the bottom section on housing 11. Thereafter the top 12 is placed over the intermediate section in the same manner as it was previously placed over the bottom section.

This intermediate section serves to enlarge the storage compartment 16 from a personal size to a party size so that more refuse can be held before it is necessary to empty the ashtray. Thus the intermediate section is placed into the ashtray before parties or other periods of heavy usage so that the ashtray will not require continual emptying. Naturally other means can be employed to fasten the cylindrical sections together such as forming cooperating threads (not shown) on the ends to be joined.

The invention claimed:

1. An ashtray comprising:

a housing having side walls and a bottom forming an internal compartment for holding cigarettes and refuse;

an intermediate section formed of side walls having the same cross-sectional configuration as the side walls;

first means to releasably fasten said intermediate section onto the side walls of said housing to extend and enlarge said internal compartment;

a top having a bottom wall and side walls to form an open receptacle to hold cigarettes and refuse;

second means to releasably fasten said top onto said intermediate section to close said internal compartment and seal the cigarettes and refuse in the compartment from the surrounding environment; and said first and second means to releasably fasten comprising pins extending inward from the housing and intermediate section and side extensions on said top and intermediate section such that by placing said top and intermediate section or said top and housing together and turning one relative to the other the included side walls are fastened together.

* * * * *